United States Patent [19]

Sitzler

[11] 4,208,561

[45] Jun. 17, 1980

[54] MICROWAVE OVEN SHELF WITH EMBEDDED GRILLE

[76] Inventor: Edward R. Sitzler, 3402 Barbour La., Louisville, Ky. 40222

[21] Appl. No.: 902,177

[22] Filed: May 2, 1978

[51] Int. Cl.[2] ..... H05B 9/06

[52] U.S. Cl. ..... 219/10.55 E; 99/444

[58] Field of Search ..... 219/10.55 E, 10.55 F; 99/444, 445, 446; D7/128, 37, 38

[56] References Cited

U.S. PATENT DOCUMENTS 4,121,510 10/1978 Frederick ..... 219/10.55 E 4,140,889 2/1979 Mason, Jr. et al. ..... 219/10.55 E

*Primary Examiner*—Arthur T. Grimley

*Attorney, Agent, or Firm*—Richard L. Caslin

[57] ABSTRACT

A shelf is shown in the bottom of a microwave oven cooking cavity. The shelf has an open grille of high temperature rigid material that is transparent to microwave energy and forms a food container - support surface. This grille is partially embedded in a molded plastic sheet which has outer sides that are slightly resilient to make a tight sealing force fit with vertical wall portions of the oven cooking cavity.

12 Claims, 7 Drawing Figures

MICROWAVE OVEN SHELF WITH EMBEDDED GRILLE

BACKGROUND OF THE INVENTION

1. Field of the Invention

This invention relates to the art of cooking foods in microwave ovens, and particularly to the design of a shelf for placement in the bottom portion of the oven cooking cavity to support containers of food to be cooked.

2. Description of the Prior Art

Most microwave ovens are furnished with microwave energy at a frequency of 2450 MHz, which is a particular type of high frequency radio energy. The energy enters the cooking cavity at the top in the form of invisible waves called microwaves. The microwave energy is distributed throughout the oven by a rotating blade or stirrer located above a plastic cover at the top of the oven.

The oven liner is formed of metal as metal serves as a reflector of microwaves to distribute the heat energy. Certain materials allow microwaves to pass through without becoming heated, such as glass, glass ceramics, paper and the like. These materials make good food containers. Other materials, such as most foods, absorb microwaves which produces heat within the food by causing the vibration of the food molecules.

Microwave cooking differs from conventional radiant energy cooking. In conventional oven cooking, either gas or electric, heat is applied around the outside of the food by radiant energy or convection heat, and the heat is slowly transferred to the inside. When cooking with microwave energy, the food is cooked from the inside out. The oven cooking cavity does not heat up like a conventional oven. Although in a microwave oven the food does get hot and this heat is transferred to the food container. Thus it is important that the food container be supported by a shelf which can withstand high temperatures.

Most microwave oven shelves are made of glass ceramic plates which are located in the bottom of the oven cooking cavity. Since the food does get hot, food spatters do occur and water vapor does rise from the food and they may soil the walls forming the oven cooking cavity. Since the oven walls are not heated, the soil tends to run down and accumulate on the shelf or beneath the shelf on the bottom wall of the oven liner.

This liquid accumulation on the bottom of the metal oven liner is very objectionable because it attacks the welded corners or seams of the box-like oven liner and rust or corrosion may occur. The conventional solution is to provide a silicone seal around the edge of the glass-ceramic shelf to seal the gap between the shelf and vertical wall portions of the oven cooking cavity.

This presents a problem in replacing the glass-ceramic shelf upon breakage since it is sealed in place. Also it is easier to maintain the cleanliness of the shelf if it can be removed from the oven and cleaned in the sink.

OBJECTS OF THE PRESENT INVENTION

The principal object of the present invention is to provide a plastic shelf having embedded therein a high temperature open grille that is transparent to microwave energy.

A further object of the present invention is to provide a shelf of the class described where the top surface of the grille is spaced above the main surface of the plastic shelf to protect the plastic from the elevated temperatures of the food container.

A further object of the present invention is to provide the shelf with resilient side portions for making a tight sealing force fit with vertical wall portions of a microwave oven cooking cavity.

A further object of the present invention is to provide a plastic shelf with a reinforcing open grille that serves as a food container-supporting surface.

SUMMARY OF THE INVENTION

The present invention provides a shelf for use in a microwave oven. The shelf is made of materials that are transparent to microwave energy. There is an open grille of rigid high temperature material that is formed with closely spaced ribs that serve as food container-supporting surfaces. This grille is partially embedded in a molded sheet of lower temperature material. The top surface of the grille is raised above the main surface of the molded sheet so as to space the sheet away from the elevated temperature of the food containers.

The outer sides of the molded sheet are slightly resilient and of a size to make a tight sealing engagement with vertical wall portions that form part of the cooking cavity. Thus the shelf of the present invention represents an imperforate shelf that serves as a support means for food containers and it also serves to catch any spill-overs or accumulations of food soil or liquids so they do not enter the area beneath the shelf and require them to be cleaned out.

BRIEF DESCRIPTION OF THE DRAWINGS

This invention will be better understood from the present description taken in conjunction with the accompanying drawings and its scope will be pointed out in the appended claims.

DESCRIPTION OF THE PREFERRED EMBODIMENTS

Figure 1:
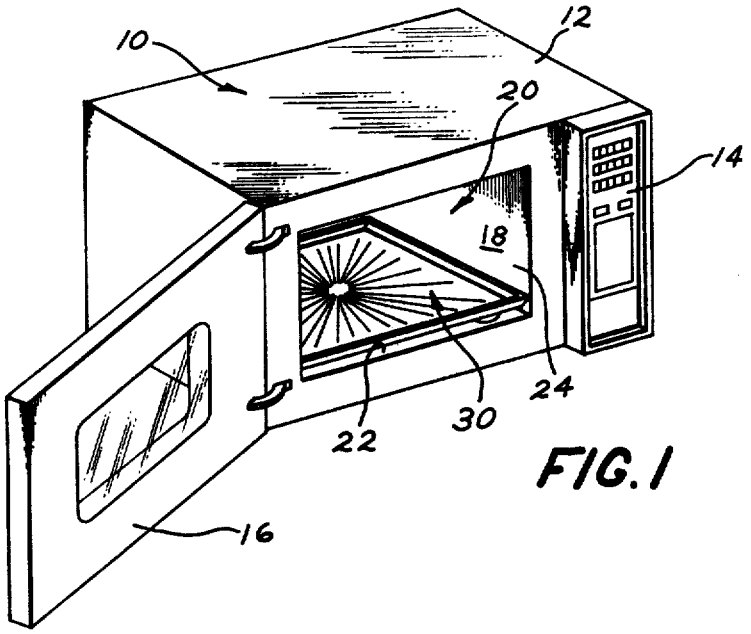
FIG. 1 is a perspective view of a countertop microwave oven shown with the front access door open to expose to view the oven shelf of the present invention in the lower portion of the oven cooking cavity. This particular shelf modification has an open grille that is generally in the form of a sunburst with radial ribs. The grille is partially embedded in a molded sheet or panel which has outer sides that sealingly engage the adjacent walls of the oven cooking cavity.

Turning now to a consideration of the drawings and, in particular, to the perspective view of the countertop microwave oven 10 of FIG. 1, there is shown the box-like outer cabinet 12, the front control panel 14, the front-opening access door 16 and the oven cooking cavity 18. The oven cavity 18 is formed by a box-like oven liner 20 which has a bottom wall 22, opposite vertical side walls 24, and a rear wall and a top wall that are not shown.

The magnetron and power supply for generating the microwave energy, and the waveguide and mode stirrer for distributing the energy throughout the oven cavity are not illustrated because they do not form part of the present invention. The mode stirrer is usually located in the top portion of the oven cavity and the energy enters the cavity from the top area of the oven.

Figure 3:
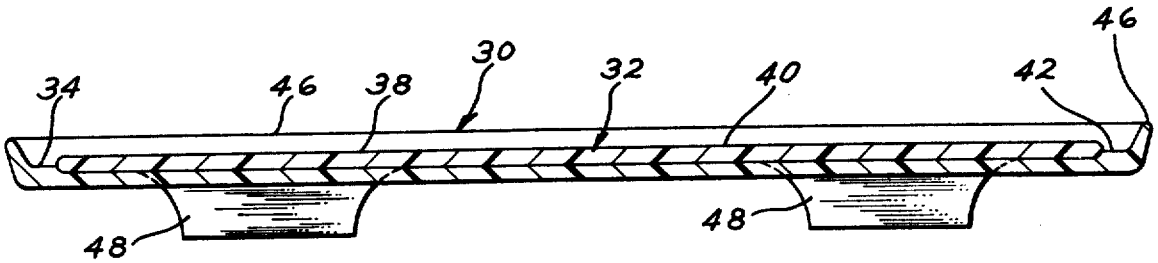
FIG. 3 is a cross-sectional elevational view of a complete shelf having the grille partially embedded in a molded sheet or panel, and taken on the line 3—3 of FIG. 2. Notice that the supporting feet of the shelf are integral with the grille and located on the two cross-diagonals that extend to the four corners of the shelf.

The present invention relates to an oven shelf 30 that is supported on the bottom wall 22 of the oven liner 20. This bottom wall 22 is shown flat but it may be recessed or have over formations or configurations built into it. As is best seen in FIG. 3, the oven shelf 30 is made of two parts; grille 32 for supporting food containers and a molded sheet or panel 34 in which the grille is partially embedded.

Figure 2:
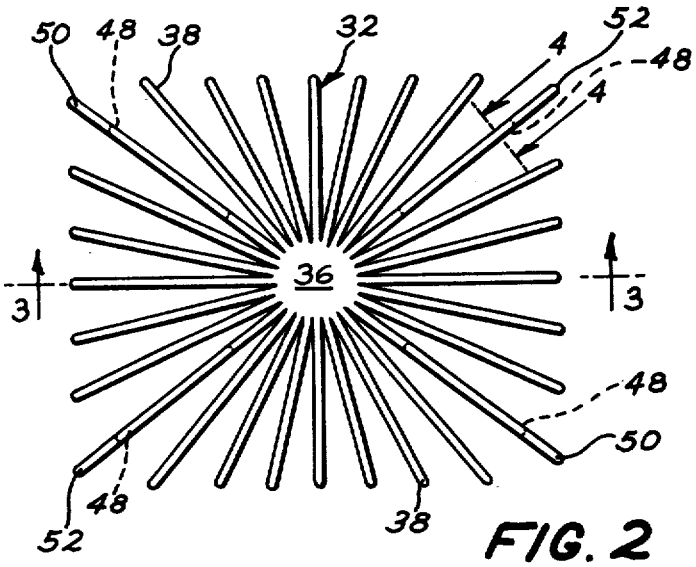
FIG. 2 is a top plan view of the open grille of the oven shelf of FIG. 1, where the grille is in the design of a sunburst.

The grille 32 is shown in top plan view in FIG. 2. The grille is an open formation having a central portion 36 and a plurality of radial ribs 38. The grille is a molded part which is made of a rigid, high temperature material that is transparent to microwave energy; such as, polysulfone, glass or glass ceramic material.

Microwave ovens should not have metal objects in them that will both absorb and reflect the microwaves, for the metal objects will heat up and the reflections may reach back to the magnetron and cause failure of the system. This explains why the conventional cooking utensils for microwave ovens are heat tempered glass, china, ceramic, pottery, glass ceramics, plastic and paper. The objective is to have most of the heat generated within the food to be cooked, rather than in the food container or in the shelf or oven walls. This explains the main advantage of microwave oven cooking; namely, high efficiency in the use of heating energy and the increased speed of cooking compared to radiant and convection oven heating systems.

The shelf in a conventional microwave oven is made as a solid glass plate or a solid glass ceramic plate. These shelves are expensive, they may cause scratches of food containers, they are difficult to decorate and it is difficult to seal the edges of the shelves to the adjacent walls of the oven liner and door.

The grille 32 has closely spaced ribs 38 to serve as a support means for food containers. However, the shelf 30 must be capable of catching any spillage or drippings that are present and to prevent them from accumulating beneath the shelf. Thus, the grille 32 is molded into a plastic sheet or panel 34 to form a unitary shelf assembly of shallow pan configuration, as is best seen in FIGS. 1 and 3. This plastic material is a low cost material that is also transparent to microwave energy, such as polypropylene or styrene. The open grille 32 is a rigid member which serves to reinforce the plastic sheet 34 as well as serve as a support means for food containers. The top surface 40 of the grille is raised above the main surface 42 of the plastic sheet 34 so as to space and protect the sheet away from the elevated temperatures of the food containers. As mentioned eariler, the food containers are transparent to microwave energy and therefor do not become heated by the microwaves. However, the food in the container becomes heated, and this heat is conducted from the food to the container. Thus the containers do heat up, but not from the microwaves directly.

The outer sides 46 of the molded sheet are slightly resilient and in the form of upwardly and outwardly inclined side walls to form a shallow pan configuration. These resilient side walls 46 are of a size relative to the dimensions of the walls of the oven liner 20 that they make a tight sealing engagement with the vertical walls of the oven liner and with the inner side of the door 16 when the door is closed and locked. This tight seal prevents any spillage or drippings from passing down under the shelf. Instead the spillage and drippings are captured by the shelf 30 from where they may be removed by cleaning in place, or the shelf may be carried to the kitchen sink for washing.

Figure 4:
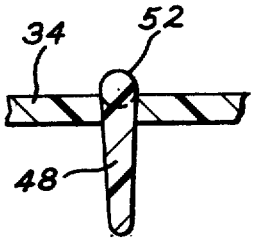
FIG. 4 is a fragmentary cross-sectional elevation view taken through one of the supporting feet of the grille on the line 4—4 of FIG. 2, but showing the grille embedded in the molded sheet or panel.

The shelf 30 is provided with supporting feet 48 which may be integral with the grille 32 or with the molded sheet 34. In FIGS. 3 and 4 the feet are shown integral with the grille 32. The feet 48 are located near the distal end of each diagonal rib 50 and 52 which extends toward the corners of the rectangular molded sheet 34.

Figure 5:
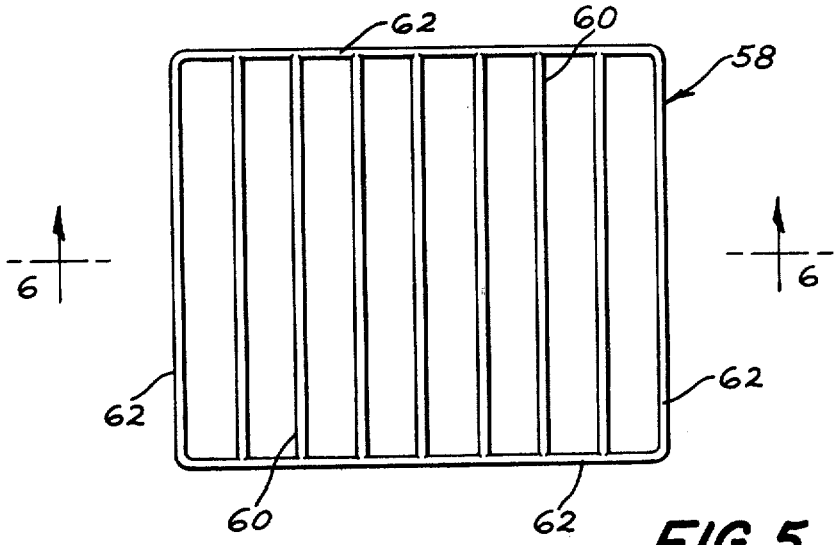
FIG. 5 is a top plan view of a second modification of open grille showing it in the shape of a gridiron with a plurality of parallel ribs that are supported within a rectangular frame.
Figure 6:
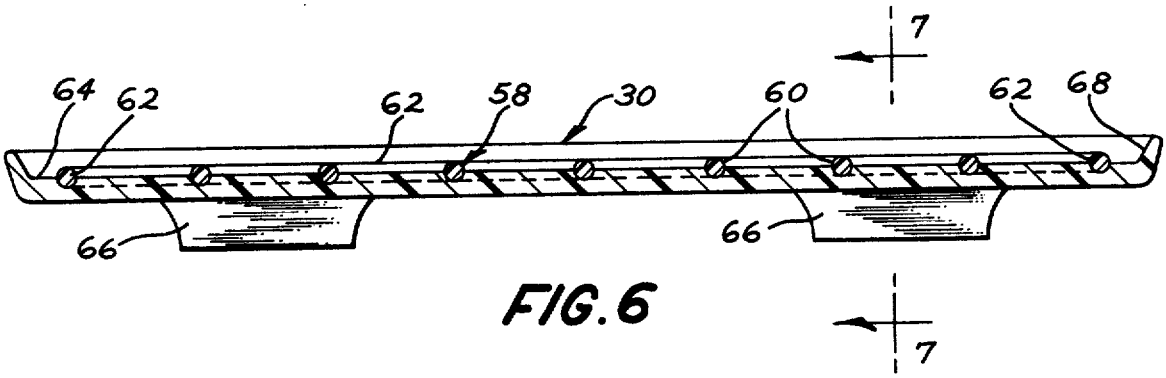
FIG. 6 is a cross-sectional elevational view of a complete oven shelf of the second modification taken on the line 6—6 of FIG. 5, but with the grille partially embedded in the molded sheet or panel.
Figure 7:
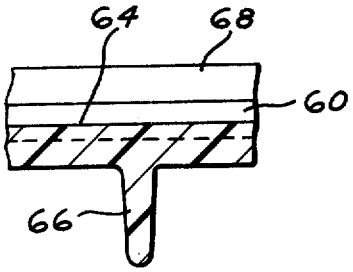
FIG. 7 is a fragmentary cross-sectional elevational view taken on the line 7—7 of FIG. 6 along the direction of one of the supporting feet of the shelf which is an extension of the molded sheet or panel.

Now turning to the second modification of FIGS. 5–7, there is a different open grille 58 that has generally a gridiron pattern with a plurality of generally parallel ribs 60 that are supported at their ends on a surrounding frame 62. This grille 58 is molded of the same materials as the first grille 32. The grille 58 is also made to be molded into a molded sheet or panel 64 which is similar to molded sheet 34 of FIG. 3. There is one difference however. The shelf 30 of FIG. 6 has supporting feet 66 which are integral with the molded sheet 64 and extend downwardly from the underside of the sheet, as is best seen in FIG. 7. The sheet 64 also has resilient inclined side walls 68 similar to the outer sides 46 of FIG. 3.

The ribs 38 of FIG. 3 and 60 of FIG. 6 may have other transverse cross-sections than the circular cross-sections that are illustrated. They may be square, triangular with the base molded in the plastic sheet or other similar shapes which would enhance their power not to be separated from the molded sheet 34 or 64.

Another modification would be to mold the grille in a decorative or artistic pattern, perhaps the corporate monogram or logo of the oven manufacturer.

Having described above my invention of a microwave oven shelf formed with an open grille that is molded into a shallow plastic pan configuration, it will be appreciated by those skilled in this art that the molded oven shelf using plastics is a low cost process. The overall shelf cost would be about one half that of the conventional microwave oven shelf. The cost of the plastic sheet 34 or 64 would be about one fourth of the cost of the grille 32 or 58.

Modifications of this invention will occur to those skilled in this art. Therefore, it is to be understood that this invention is not limited to the particular embodiments disclosed, but that it is intended to cover all modifications which are within the true spirit and scope of this invention as claimed.

What is claimed is:

1. A shelf of at least two different materials for use in a microwave oven comprising:

an open grille of rigid high temperature material that is transparent to microwave energy, said grille having closely spaced ribs which form a food container-supporting surface;

a molded sheet of lower temperature material, that is transparent to microwave energy, in which the said grille is partially embedded so as to form a unitary shelf assembly, the top surface of the grille being raised above the main surface of the molded sheet to space and protect the sheet away from the elevated temperature of the food containers.

2. The invention of claim 1 wherein the outer sides of the molded sheet are slightly resilient and of a size relative to the cooking cavity dimensions of a preselected microwave oven so as to be adapted to make a tight sealing engagement with wall portions forming the cooking cavity.

3. The invention of claim 2 wherein the molded sheet is of thermoplastic material with upwardly and outwardly inclined side walls to form a shallow pan configuration.

4. The invention of claim 1 wherein the open grille is provided with feet portions which extend downwardly from the underside of the molded sheet and are adapted to support the shelf from a bottom wall of the oven cooking cavity.

5. The invention of claim 1 wherein the open grille is of molded glass ceramic material.

6. The invention of claim 1 wherein the open grille has generally a sunburst pattern with a plurality of radial ribs.

7. The invention of claim 1 wherein the open grille has generally a gridiron pattern with a plurality of parallel ribs with a surrounding connecting frame.

8. The invention of claim 1 wherein the underside of the molded sheet is provided with a plurality of feet portions that are adapted to support the shelf from a bottom wall of the oven cooking cavity.

9. The invention of claim 1 wherein the open grille is formed of one of the materials taken from the class comprising polysulfone, glass and glass ceramic materials.

10. The invention of claim 1 wherein the molded sheet is formed of one of the materials taken from the class comprising polypropylene and styrene.

11. The invention of claim 10 wherein the open grille is formed of one of the materials taken from the class comprising polysulfone, glass and glass ceramic materials.

12. The invention of claim 2 wherein the open grille is formed of one of the materials taken from the class comprising polysulfone, glass and glass ceramic materials, and the molded sheet is formed of one of the materials taken from the class comprising polypropylene and styrene.

* * * * *